United States Patent [19]

Boot et al.

[11] 3,979,865

[45] Sept. 14, 1976

[54] BUILDING CONSTRUCTION FORMED OF STACKABLE BUILDING CELLS

[75] Inventors: Phillip Handford Boot, Mosman; Peter Edington Ellen, Turramurra, both of Australia

[73] Assignee: H.H. Boot & Sons Pty. Limited, Pymbler, Australia

[22] Filed: Nov. 11, 1974

[21] Appl. No.: 523,004

Related U.S. Application Data

[63] Continuation-in-part of Ser. No. 358,802, May 9, 1973, abandoned.

[30] Foreign Application Priority Data

Nov. 9, 1973 Australia ..... 5607/73

[52] U.S. Cl. ..... 52/236; 52/79; 52/80

[51] Int. Cl.[2] ..... E04H 1/04

[58] Field of Search ..... 52/236, 79, 80, 82, 52/85, 86, 91, 262, 743, 745, 758 B

[56] References Cited

UNITED STATES PATENTS

| | | | |
|---|---|---|---|
| 1,185,871 | 6/1916 | Broughton | 52/262 X |
| 2,267,912 | 12/1941 | Hain | 52/80 X |
| 3,228,161 | 1/1966 | McCown | 52/758 B |
| 3,286,415 | 1/1966 | Schlenker | 52/86 |
| 3,365,846 | 1/1968 | Sperling | 52/86 |
| 3,455,074 | 7/1969 | Rice | 52/262 X |
| 3,690,077 | 9/1972 | Dalgliesh | 52/79 |
| 3,706,168 | 12/1972 | Pilish | 52/262 X |
| 3,712,007 | 1/1973 | Kump | 52/236 X |
| 3,714,304 | 1/1973 | Carner et al. | 52/745 X |
| 3,758,998 | 9/1973 | Ollis et al. | 52/236 X |
| 3,772,835 | 11/1973 | Cox et al. | 52/91 X |

FOREIGN PATENTS OR APPLICATIONS

| | | | |
|---|---|---|---|
| 1,269,080 | 7/1961 | France | 52/236 |
| 1,428,503 | 1/1966 | France | 52/236 |
| 1,027,807 | 4/1966 | United Kingdom | 52/82 |
| 649,729 | 1/1951 | United Kingdom | 52/82 |

*Primary Examiner*—Price C. Faw, Jr.
*Assistant Examiner*—Leslie A. Braun
*Attorney, Agent, or Firm*—Murray and Whisenhunt

[57] ABSTRACT

A building comprising a plurality of structurally stable building cells is disclosed, wherein the cells are structured so that each forms at least part of a room of the building. Each cell has at least three planar, substantially vertical walls having an average thickness of about ¼ inch to about 2 inches, except in areas of localized thickening. The cell has a roof in the form of a structure having substantially the structural action of a double curved thinshelled dome, which extends from the tops of the walls to form an integral concrete structure. The roof has a rise to chord ratio between 1:10 and 1:60. The roof is also about ¼ inch to about 2 inches thick, except in areas of localized thickening. The roof and the top of the walls are joined by a continuous edge stiffening member, and a floor is joined to the bottom of the walls. Two or more of these cells are stacked one over the other in a generally vertical relationship in the building.

18 Claims, 20 Drawing Figures

Figure 1:
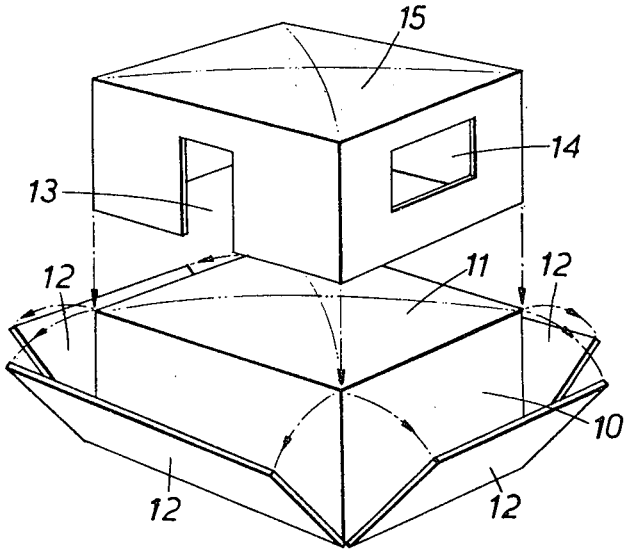

FIG. 7.
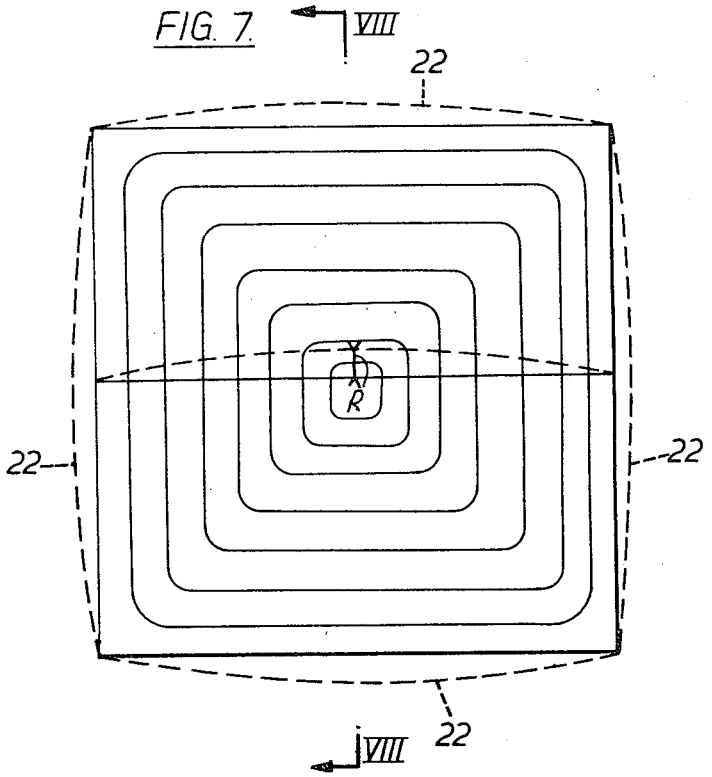
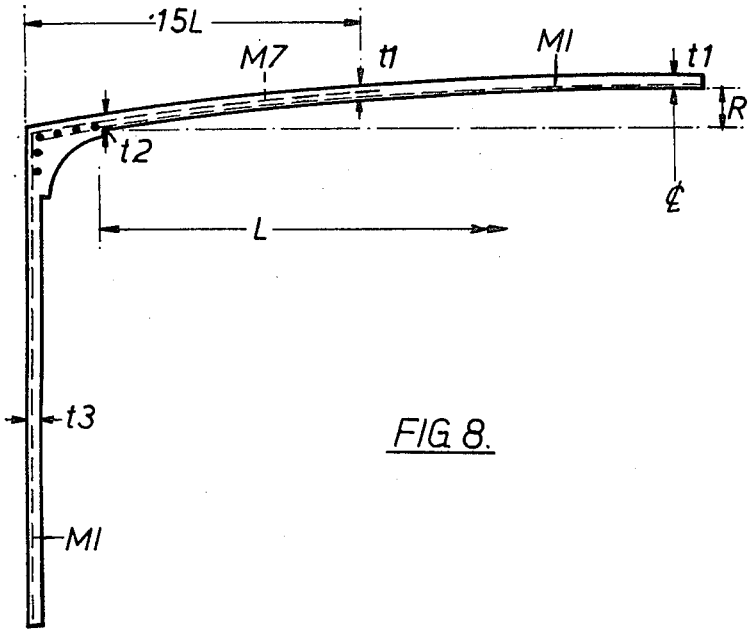
FIG. 8.

BUILDING CONSTRUCTION FORMED OF STACKABLE BUILDING CELLS

CROSS REFERENCE TO RELATED APPLICATION

This application is a continuation-in-part of copending application Ser. No. 358,802, filed May 9, 1973 now abandoned.

The present invention relates to improvements in or relating to building construction and more particularly to the provision of building cells, boxes or modules (for convenience the word "cell" will be used in this specification to designate all such structures) from which both single and multi-story buildings may be constructed.

At the present time the majority of dwellings are constructed by conventional methods and while quite satisfactory results are produced, the ever increasing cost of buildings by reason, for example, of the costs attributable to labor, has led to a situation in which new methods of building are continually being sought. In the production of timber dwellings, for example, it is now common practice in certain countries to manufacture individual rooms or groups of rooms completely in a factory and assemble them on the site with a useful increase in economy and efficiency.

The object of the present invention is to enable such methods to be better used in the construction of buildings made from concrete. Whilst such material is durable and universally acceptable as a high quality material of reasonable cost, no wholly satisfactory method of factory manufacture using it is available.

The present invention is centered around the concept of making individual rooms or groups of rooms as cells that can be completed wholly or substantially in a factory, or a factory like environment, thus assisting in achieving better workmanship, mechanization, quality and quantity control of materials, better purchasing power and better productivity from labor lower costs. Particular advantages in this respect can be obtained in connection with "service areas" which are the most expensive part of a building to produce per unit area. In such a method a room is produced preferably as a substantially weather sealed cell in the factory and is then transported to the site on which the building is to be erected. The desirability of this approach has been previously recognised and buildings have been erected from a number of complete cells made of reinforced concrete.

The use of reinforced concrete in a conventional way, however, has resulted in the production of relatively heavy cells, of for example 20 to 35 tons, which require very elaborate transport and lifting means to convey them from the factory to the site of erection and to erect them.

The principal object of the present invention is to produce a building cell which fulfills the requirements set out above and has the advantage of being constructed from concrete material with or without reinforcement but which can be made sufficiently light in weight as to minimize problems of transportation and erection.

The invention consists in one aspect, in a structurally stable building cell for the construction of buildings, the cell being constructed to form the whole or part of a room or rooms of a building and comprising four internally substantially flat vertical walls, a roof and a floor, the walls and the roof being a unitary integral concrete structure, the average thickness of the walls and the roof of the cell lying within the range of from ¼ inch to 2 inches except in areas of localized thickening, the roof being in the form of a structure having the structural action of or approximating to the structural action of a double curved thin shell dome sprung from the tops of the walls, the roof being joined to the walls by a continuous edge stiffening member.

The invention further consists in a structurally stable building cell for the construction of buildings, the cell being constructed to form the whole or part of a room or rooms of a building and comprising four internally substantially flat vertical walls, a roof and a floor, the walls and the roof being a unitary integral concrete structure, the weight of the wall and roof structure per net unit interior wall and roof surface area excluding areas of localized thickening being in the range of 3 to 24 lbs. per square foot, the roof being in the form of a structure having the structural action of or approximating to the structural action of a double curved thin shell dome sprung from the tops of the walls, the roof being joined to the walls by a continuous edge stiffening member.

The invention further consists in a structural stable building cell for the construction of buildings, said cell being constructed to form at least part of a room and comprising at least three planar, thin vertical walls; a roof in the form of a structure having substantially the structural action of a double curved thin shell dome sprung from the tops of said walls and forming therewith a unitary integral concrete structure, said dome-shaped roof having a rise to chord ratio not greater than 1 to 10 and not less than 1 to 60; a floor joined to the bottoms of said walls; and a continuous edge stiffening member joining said roof to said walls.

The term "dome" includes very shallow domes, generalized polyhedral domes composed of two or more rigidly interconnected thin plates, anisotropic domes, and domes having penstrations, that is to say apertures.

The term "thin shell" includes any single or double curved thin walled body, an example of the latter class being a dome.

If the curvature is continuous as for instance in the case of a thin hollow sphere, and if a distributed load is applied to the body, the stresses in the shell are essentially membrane stresses, i.e., they are tension, compression or shear stresses, all essentially uniform across the thickness of the shell and acting in directions parallel to the surface.

If the shell is made discontinuous along an edge and the edge is then stiffened, the bulk of the shell away from the stiffened edge remains in a membrane state, while some flexural action — bending, shear and torsion normal to the surface are induced in the close vicinity of the edge stiffening and act in addition to the membrane stresses in this zone.

A thin shell structure in general consists of

1. The shell
2. An edge stiffening member
3. A gradual thickening between the shell and the stiffening member.

In general for shells of similar dimensions double curved shells are stiffer than single curved shells and consequently both the reinforcement and the edge stiffening members tend to be smaller.

The above applies to all shell structures. Specific distinctions, however, may be made between the actions of particular shapes of shells. Thus a comparison may be made between the stresses induced in a cylindrical shell on a rectangular base and a dome on a base of the same shape assuming that the shells have the same rise.

For both the above shells, stress concentrations are induced in and originate from the corners of the shell. This corner zone is the most highly stressed part of the shell and failure under load almost invariably originates in this area. However, the magnitude of the stresses in the domed shell are significantly lower than the cylindrical shell. The reason for this may be understood by comparing the structural action of the two shells.

The cylindrical shell, because of its geometry, transmits the bulk of the load from any point on the shell to the supporting diaphragm by membrane shears. These induce relatively high diagonal tension stresses, which normally leads to the thickening of the shell near its support and the provisions of additional reinforcing steel in this area.

The dome on the other hand is able to transmit stresses to the support primarily by direct compression and by inducing relatively much smaller shears.

It follows that the dome is a much more efficient structure, in that for the same size and load carrying capacity it requires smaller amounts of structural material.

Shells are considered thin when, if the following alternative assumptions are made in the analytical determination of stresses and deformations, the effect is insignificant.

1. The middle centroidal and neutral surfaces are coincidental.
2. Terms of the order of $t/R$ are negligible when compared to unity where $t$ is the thickness of the shell and R is the radius of the shell at any point.

In practice a thin concrete shell is less than 3 inches thick over the bulk of its surface and its other dimensions (chord width, span, radius etc.) exceed $60t$.

There is a very extensive literature dealing with the theory of thin shells (ref. FLUGGE BIBLIOGRAPHY Page 482–Page 494). The question of limiting thickness is discussed at length. The following are some references.

W. Flugge — Stresses in Shells
Springer — Verlag 1960 Berlin Page 348.
S. P. Timoshenko and Woinowsky-Krieger
Theory of Plates and Shells
2nd Edition
McGraw-Hill Book Co., New York, 1959 Page 428
J. E. Gibson & D. W. Cooper
The Design of Cylindrical Shell Roofs
E. and F. N. Spon Ltd. London 1954 Page 1

The term "thickness of the walls and the roof" is the thickness measured transversely in areas free from ribs and other localized thickening.

A minor or major portion or the whole of one or more of the walls may be omitted to provide for door and window apertures or for the juxtaposition of two cells to form a large room.

Where a whole wall is omitted the stability of the structure is maintained by the presence of the continuous edge stiffening member around the periphery of the dome.

It is preferred that the average thickness of the walls and roof of a cell is between ⅜ inch and 1½ inches, excluding minor areas of localized thickening. In this connection the structure may be thickened locally for example by the addition of ribs on the roof or the walls, local thickening will also be present in the area of the edge stiffening member which may be in the form of a ring or system of beams or ribs. Localized thickening may also occur for example at the junction of adjacent walls. The term "roof" is not to be taken to signify that in use it is exposed to the elements and is used to refer to the top of a cell, the undersurface of the roof constituting a ceiling. It is preferred that the concrete used be reinforced with steel or other suitable reinforcing material, for example, various suitable fibrous materials. The concrete may be strengthened by the polymerisation of a suitable monomer included in the mix, impregnated or otherwise applied.

It should be noted that as one or both the major dimensions of the cell increase so will the difficulties of producing a structurally stable cell particularly if a very thin wall and roof thickness is adopted. Under these circumstances great care must be exercised in the choice of the type of concrete used, in the rise to chord ratio of the cell and the size of the edge stiffening member.

The invention may be seen as being the solution to the problem of providing a very thin light roof structure capable of supporting itself over very large spans, the lightness of the roof allowing thin light supporting walls to be used. In this aspect the invention may be regarded as consisting of a structurally stable building cell comprising four walls, a floor and a roof, at least said walls and said roof being parts of a unitary integral structure made from concrete which includes a continuous stress-resisting transition zone joining each wall to the roof, at least that part of the roof covering the areas bounded by the transition zone being domed upwardly, at least said dome having a thickness of from ¼ inch to 2 inches.

Figure 1A:
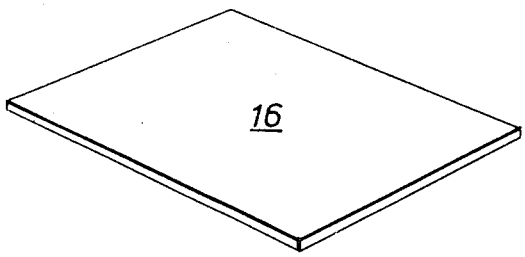
Figure 2:
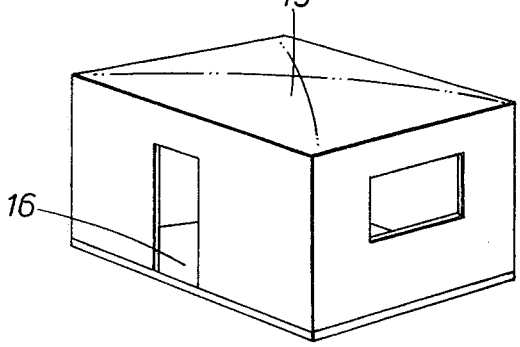

In order that the nature of the invention may be better understood details of a building cell constructed according to the invention and methods of constructing it are described, by way of example, with reference to the accompanying diagrammatic drawings in which:

FIG. 1 is a perspective view of the cast wall and roof component of a cell and the parts of an opened and retracted mould from which it has been removed, FIG. 1*a* shows a cast floor component for attachment to the wall and roof component, FIG. 2 shows the completed floor joined to the wall and roof component.

Figure 3:
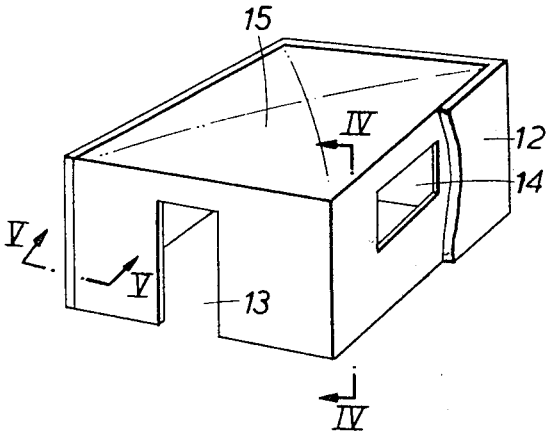
Figure 4:
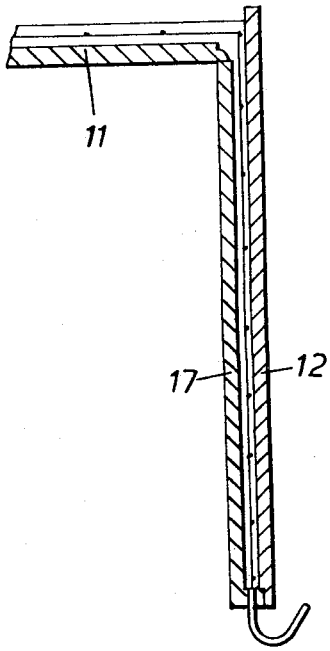
Figure 5:
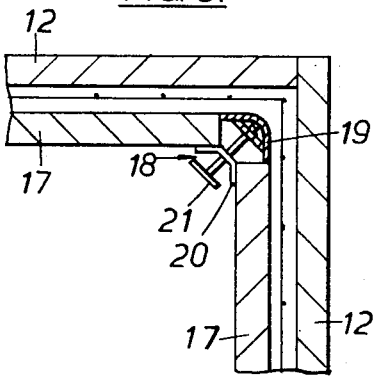
Figure 6:
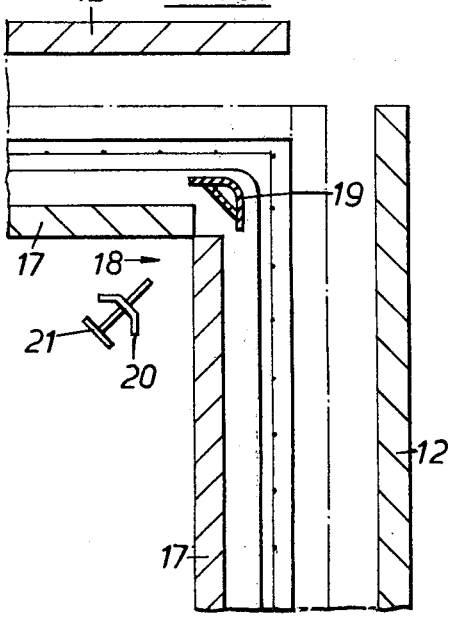
Figure 9:
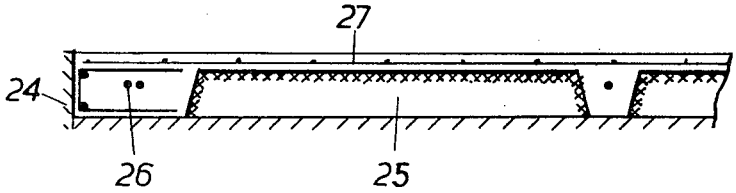
Figure 10:
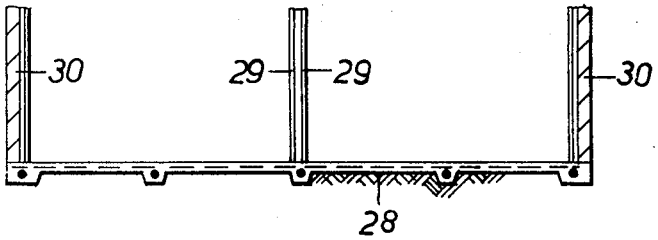
Figure 11:
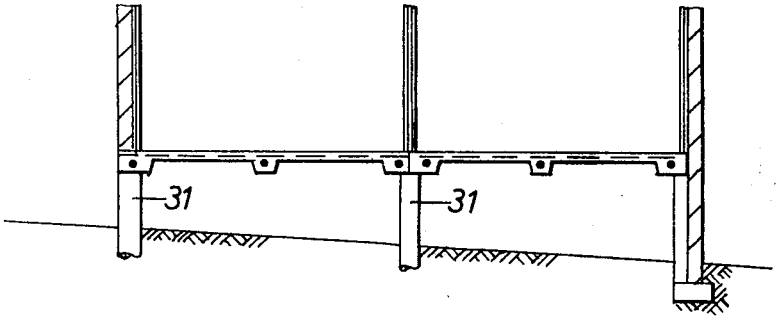
Figure 12:
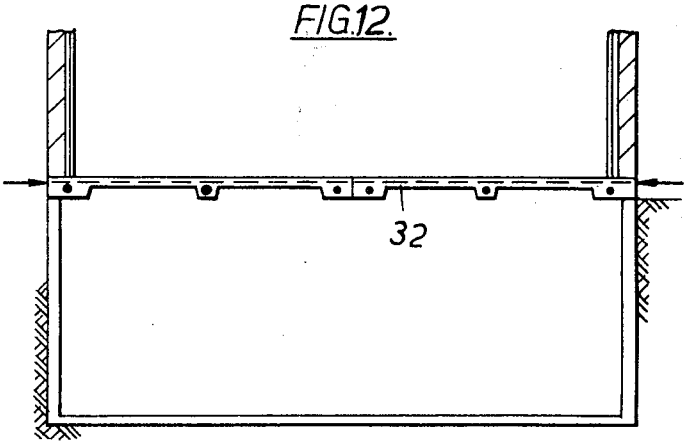
Figure 13A:
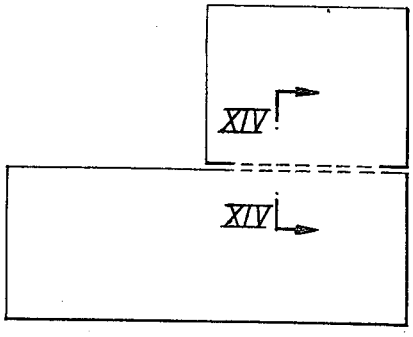
Figure 13B:
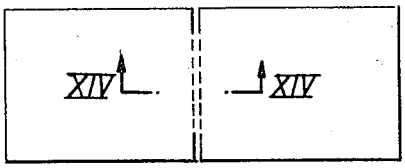
Figure 14:
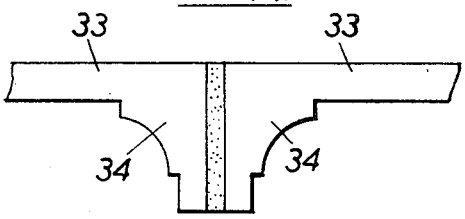

FIG. 3 is a perspective view of a cast wall and roof component with some of the external mould panels in position, the internal mould being omitted for the sake of clarity, FIG. 4 is a part cross-section on plane IV—IV of FIG. 3, FIG. 5 is a part cross-section on plane V—V of FIG. 3, FIG. 6 is a view similar to FIG. 5 but showing parts of the inner and outer mould retracted, FIG. 7 is a plan view of a cell, FIG. 8 is a cross-sectional elevation of a portion of the cell of FIG. 7 on the line VIII—VIII illustrating details of a typical arrangement of reinforcement, FIG. 9 is a cross-section of a portion of a floor component of a cell, FIG. 10 illustrates the use of the floors of cells cast in-situ, FIG. 11 illustrates the manner in which the floors of adjacent cells are supported on piers, FIG. 12 illustrates an arrangement in which the floors of adjacent cells are supported by post-tensioning cables, FIGS. 13*a* and 13*b* are plans illustrating the manner in which a substantial portion of a wall may be omitted in adjacent cells to form a large room, FIG. 14 is a cross-sectional view of portion of the roofs of adjacent cells on the line XIV—XIV of FIGS. 13*a* and 13*b*

Figure 15:
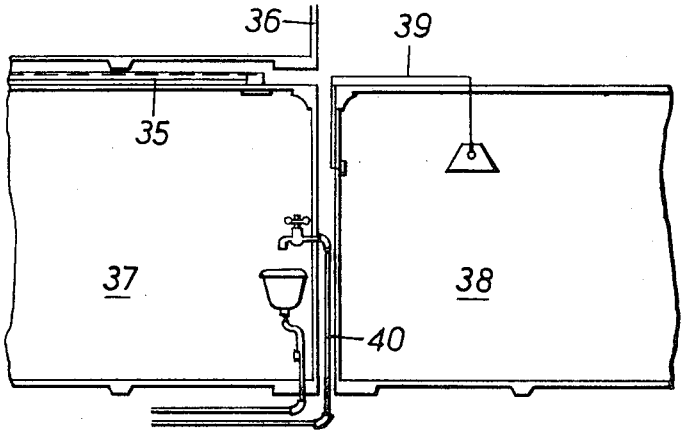
Figure 16A:
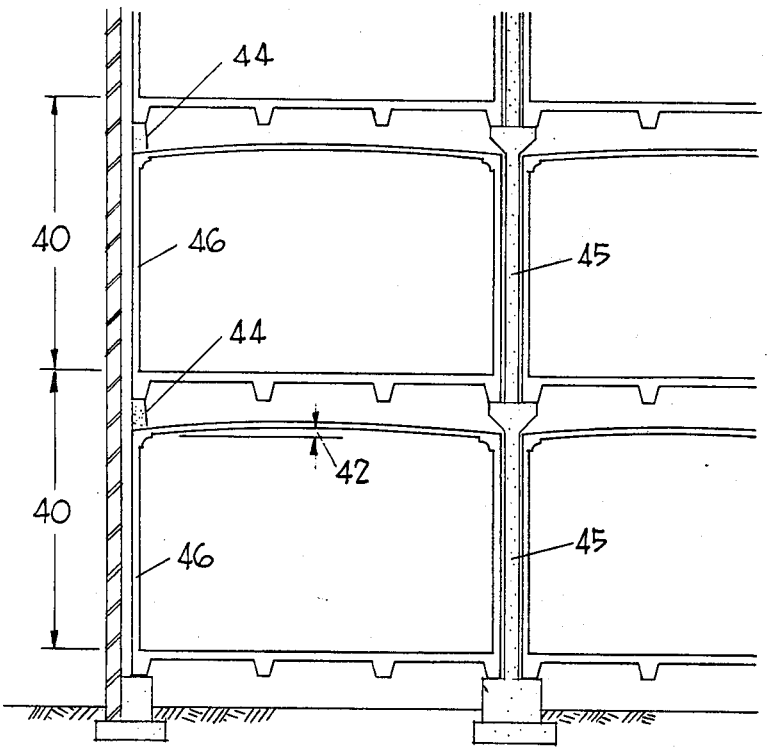
Figure 16B:
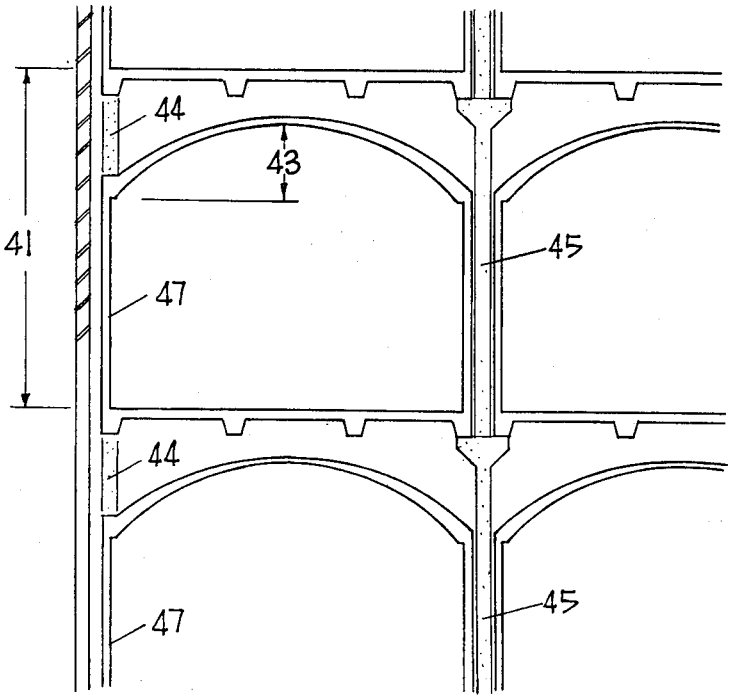
Figure 16C:
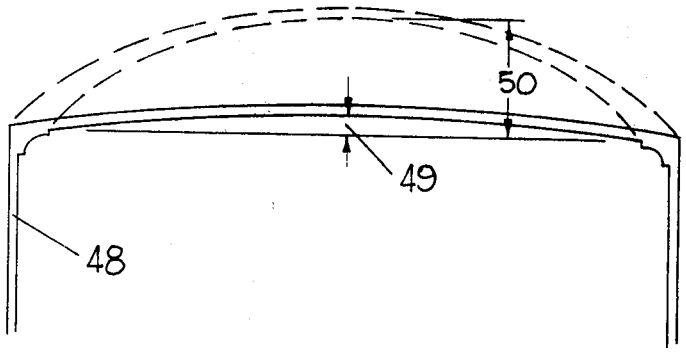

FIG. 15 illustrates the manner in which air conditioning ducts, plumbing and electrical services, and any other services required may be accommodated in the spaces between cells in a building and, FIGS. 16A, 16B, and 16C illustrate how cells may be arranged one above the other to form a multi-story building.

The application of the invention enables a building to be constructed particularly economically from a number of individual cells placed side by side in such a relationship that a complete building with the necessary rooms and intercommunication between them is formed. The invention may be applied to the construction of cells for building single story buildings or multistory buildings, the latter being formed by placing cells one on top of the other with adequate structural support as required. Thus the organization of the manufacture of individual cells is orientated towards accomplishing these objectives. A single cell is normally a complete unit consisting of a component which forms the floor and a component which forms the walls and roof, the latter component being preferably formed in one piece. Each cell is not necessarily complete in its entirety as parts or whole sections or whole walls may be omitted to provide for door or window openings or to enable two cells to be arranged side by side to form a larger room. This will be described in more detail below.

Cells are preferably constructed by methods described below, from concrete made up of an aggregate or aggregates bound by a matrix composed of ordinary portland cement, high alumina cements, synthetic resins and/or any combination of cementitious materials and suitable additives which can be structurally integrated. The aggregate may be natural or synthetic. An example of a suitable material is concrete made from portland cement, sand and water together with conventional additives.

As stated above, each cell is made up of two components, one component consisting of the walls and roof which may be moulded as an integral unit. The other component is the floor which is preferably cast as a flat surfaced concrete slab and subsequently joined to the walls as described below. Other types of floor, for example, wooden or metal flooring may be used but these are not preferred. The floor apart from its function as such may also act to stiffen the walls.

In order to facilitate the transport and erection of cells they should be made as light as possible consistent with stability. Calculations indicate that it should be possible to make cells according to the invention of the order of 25% in large sizes and 33% in small sizes of the weight of a similar cell designed on lines at present in use. It is in achieving this objective that the difficulty lies and in which the principal feature of the present invention is to be found. The invention makes use of cell walls of an average thickness of between ¼ inch and 2 inches, and preferably between ⅜ inch and 1½ inches excluding ribs or local thickening, preferably reinforced with suitable reinforcing material such as steel. A similar thickness is adopted for the roof of the cell. However, if such a thin structure were to be designed on conventional lines utilizing a slab roof, it would be relatively weak and unstable. The present invention, however, overcomes this difficulty by the use in association with the thin walls of a domed roof structure having the characteristics defined above joined to the walls by a certain edge stiffening member. The roof is made of thin concrete preferably either of substantially uniform thickness or of a thickness that diminishes towards the center and with a relatively low rise to chord ratio of from 1:10 to 1:60 and is preferably cast monolithically with the walls. It may, however, be cast separately and joined to the walls, for example, by structural grouting. The continuous edge stiffening member may be in the form of edges of the roof which contains a ring or system of beams or ribs or thickening or strengthening to stiffen the edges of the roof. It may be in the form of a cornice cast integrally with the structure. The beam may if desired project upwardly above the junction of the roof and walls.

Looked at from a different point of view it may be said that if the roof of the cell were constructed on conventional lines, that is to say, as a flat slab and made very thin it would collapse. If however, it were made sufficiently thick to be self-supporting this would necessarily involve the use of relatively thick walls to support the roof, thus preventing the achievement of the object of the invention, namely the production of a light cell. The invention however overcomes the difficulty by adopting a dome roofed structure which permits the roof to be made thin and thus of light weight permitting the use of thin walls to support it and providing a light-weight cell.

In connection with the range of rise to chord ratio given above it should be appreciated that while it would be technically possible to produce a roof having the necessary stiffening effect with a rise to chord ratio greater than 1:10, such a curvature might be unattractive and possibly unacceptable. The use of such a ratio in a multi-story building will tend to result in a unacceptable waste of space. At the other end of the scale, with a rise to chord ratio approaching 1:60, it is considered that it may be necessary to further strengthen the edges of the roof.

Both walls and roof may be provided with integrally cast external ribs to enable a lesser thickness of concrete to be used over the main areas, if by this means an overall reduction in the amount of material used can be obtained in a particular structure. Tests have shown that the presence of external ribs in cell walls can give a marked increase in strength without increasing the materials used. There is however a danger in the use of external ribs in that stress concentrations can be set up leading to unsightly cracking, and they can also interfere in the membrane stress patterns in the dome; great care must therefore be taken in the use of ribs.

FIGS. 1 and 2 illustrate the basic procedure in the construction of a cell according to the invention. In FIG. 1 is shown a double mould consisting of an internal rectangular mould 10 with an upwardly convex top 11 surrounded by four moveable external mould panels 12. Apertures for a door and window are indicated at 13 and 14 in the cast wall and roof element 15 which has been lifted from the mould by means of a crane or suitable lifting gear (not shown). FIG. 1*a* shows a cast concrete floor slab 16 the construction of which is described in more detail below. FIG. 2 shows the two components of the cell namely the integral wall and roof component 15 and the floor slab 16 joined, the cell being ready for internal finishing.

Some details of the type of mould to be used in the preferred method of moulding of cell units according to the invention are shown in FIGS. 3 to 6. This method involves the use of retractable internal wall mould panels 17 and four removable external wall mould panels 12. It is necessary for the internal mould panels to be retractable to enable the monolithically cast wall and roof component of the cell to be removed from it. This is achieved by the corner details shown in FIGS. 5 and 6 which show two internal wall panel moulds 17 joined by a corner joint 18 which during the moulding process is set up as shown in FIG. 5, the external wall mould panels 12 spaced apart from the internal panels 17 in accordance with the thickness of the walls to be produced. It will be seen that this corner joint 18 provides an accurate right angle joint at the junction of the adjacent mould walls. The corner joint 18 consists of an outer corner member 19 and an inner corner member 20 which are connected by a number of hand screws 21. When the joint is assembled as in FIG. 5 the parts of the mould are held in their correct relative positions for carrying out the moulding operation. After the wall and roof component has set the screws 21 and inner corner member 20 are moved, allowing the inner mould panels 17 to be retracted as shown in FIG. 6. This permits the wall and roof component to be lifted clear of the mould after the external mould panels 12 have been removed.

The moulding process is illustrated in FIG. 4 in which concrete grout is shown as being pumped into the space between the internal and external mould panels 12 and 17, from a point at or near the bottom of the mould walls. The concrete is pumped in as grout in a relatively liquid form and rises in the space between the mould panels, driving out air and thus substantially avoiding the production of voids in the concrete. Reinforcing steel, which may be in the form of a layer or layers of welded mesh fabric is placed around the internal wall mould panels 17 before the assembly of the external wall mould panels; the concrete rises through this embedding it as it rises. Any window frames, door frames, or alternate fixing brackets or sub-frames, etc., to be included in the cell structure, are also placed between the mould walls when the reinforcing steel is being placed in position and the concrete will thus flow around these. Alternatively, blockouts may be used to define the desired appertures. In addition to the reinforcing steel and door and window frames, a variety of other minor parts are advantageously set in position in the moulds before introducing the concrete, such things, for example as lifting clips, brackets, lugs and steel plates. Steel plates are built into the bottom of the walls to enable the wall and roof component to be secured to the floor slab by welding to a similar corresponding steel plate set in the floor slab.

When the concrete has risen to its full height between the internal and external wall mould panels 17 and 12, the concrete is then applied over the top of the internal mould in a layer to form the upwardly covex rectangular domed roof.

During the moulding process the mould is subjected to vibration with a view to eliminating voids and compacting the grout. The roof in this case is reinforced, preferably with steel mesh in a manner similar to the walls.

In the general application of the invention some reinforcing steel or other suitable reinforcing material may be required for both walls and roof in view of the thin shell structure. Where steel reinforcement is used it is considered that reinforcing percentages up to a maximum of 10% of the cross-sectional area of the concrete will be employed depending on the size and configuration of the cell.

The plan view of a cell shown in FIG. 7 is intended to illustrate by contour lines the fact that the roof is a domed shell sprung from the walls. The broken line 22 illustrates the shape that the cell will tend to assume, a tendency resisted by the stiffening around the periphery of the roof.

FIG. 8 shows the manner in which stiffening may be in the form of a reinforced concrete cornice, the cornice being visible from the interior of the cell and forming an architectural feature of it. This drawing also illustrates the domed nature of the roof.

FIG. 8 also illustrates a typical arrangement of reinforcement in the wall and roof component. In areas indicated at Mi a single layer of steel welded mesh fabric is used and in the area M7 two layers of similar material.

In the table set out below are some typical dimensions which a cell may assume together with particulars of wall and roof thickness and reinforcement for each case. In the table $t_1$, $t_2$ and $t_3$ are the thicknesses at the points so indicated in FIG. 8, the thickness being substantially constant between the two marked $t_1$ and increases uniformly from the left hand point marked $t_1$ to that marked $t_2$ which represents localised thickening.

FIG. 8 also serves to illustrate what is meant by the rise and chord of the shell of the roof in the most usual case where the edge of the shell is well defined. L applies to the smaller of the overall cell dimensions and the rise of the shell is indicated at R. Where the roof and wall form a continuous surface the chord and rise are measured over the middle 70% of the overall width of the cell. Where the roof and continuous edge stiffening member form a continuous surface the chord and rise are measured over the middle 50% of the overall width of the cell. The distance between the left hand point indicated at $t_1$ and the edge of the wall is 0.15L. Rise to chord measurements are in all cases made in relation to the internal surface of the roof.

TABLE

| Room Dmns o/all | $t_1$ | $t_2$ | $t_3$ | R | Conc. or grout stgth F'c | Mesh M1 | Mesh M7 (two layers) | Reinf. in Edge Stiffening |
|---|---|---|---|---|---|---|---|---|
| 8' × 8' | ⅜" | 1" | 1" | 4" | 4,000 lbs./sq. inch. | .03 sq. in. per ft. | .03 sq. in. per ft. | .5 sq. in. |
| 10' × 12' | ½" | 1¼" | 1" | 5" | " | .03 " | .06 " | .8 " |
| 10' × 15' | ¾" | 1½" | 1¼" | 6" | " | .03 " | .08 " | 1.0 " |

TABLE -continued

| Room Dmns o/all | $t_1$ | $t_2$ | $t_3$ | R | Conc. or grout stgth F'c | Mesh M1 | Mesh M7 (two layers) | Reinf. in Edge Stiffening |
|---|---|---|---|---|---|---|---|---|
| 15' × 15' | ¾" | 2" | 1½" | 8" | " | .03 " | .12 " | 1.2 " |
| 15' × 24' | 1½" | 2½" | 2" | 10" | " | .06 " | .14 " | 1.5 " |
| 18' × 18' | 1½" | 2½" | 2" | 12" | " | .06 " | .14 " | 1.8 " |

The references to areas are to cross sectional areas of the reinforcing material.

Another method of forming the wall roof component of the cell is by means of a single skin mould. In this case, the concrete is applied by hand to the exterior of the inner mould by spraying or trowelling after the reinforcing steel if required has been placed in position. This method of manufacture is considered less satisfactory than that described above, in that the amount of labour involved is greater and the chance of leaving voids in the concrete is also greater. However, the capital cost of the mould is considerably less.

Alternatively the roof and each wall or a combination of these may be manufactured separately and then joined to form a unitary integral structure. Where this procedure is followed the parts of a cell may be assembled at a location other than the factory in which they are manufactured.

A floor for the cell is made in a conventional manner one example or a floor being illustrated in FIG. 9. This is made by casting concrete into formwork consisting of edge forms 24 and panforms 25 arranged in a waffle pattern, pretensioned cables 26 and a reinforcing mesh 27 being set in position before pouring. When the floor has set and cured it is secured to the walls of the cell by welding the steel plates of the two components together as described above.

After connection of the floor to the upper component of the cell the joint between the floor and the walls is grouted or sealed as necessary, defects in the cell if any repaired and it is generally prepared for finishing. Plumbing, pipes, taps, wastes etc. are installed and all necessary preliminary electrical work carried out. Kitchen cupboards, sinks, bench tops, etc., are installed, tiled and in fact, all internal fittings and furnishings that would normally be installed by a builder in a conventionally built building may be built into the cells in the factory and the interior of each cell can be completely painted, finished and sealed against the entry of weather.

The physical characteristics of an experimental cell constructed according to the present invention and having an external appearance substantially as shown in FIG. 2, and an internal cornice as shown in FIG. 8 are as follows:

INSIDE DIMENSIONS

Width 9.08'
Length 12.5'
Height 8' to the underside of the cornice
Height from the grounnd at centre of the roof — 8.54'
Wall thickness in unthickened areas — 1",
Weight of roof and wall unit — 2.9 tons,
Weight of floor — 1.9 tons,
Total weight — 4.8 tons
Window — 3'11¾" × 6'5⅞"
Door — 2'11⅛ × 6' 9 11/16"

REINFORCEMENT

Reinforcing steel was provided throughout the wall roof component on the basis of a content of 1.3% of the cross-sectional area of the concrete corresponding to a minimum of 2 layers of 2 inches × 2 inches × 10 S.W.G. galvanised steel wire fabric. Additional fabric was placed in critical areas, for example, the thickened and strengthened areas, constituted by the cornice and areas adjacent thereto.

In the cornice 5 × ½ inches diameter reinforcing bars of steel, were included.

FLOOR PANEL

This is constructed as a conventional reinforced waffle slab concrete floor.

ROOF

This has on the shortest span, a rise of 2.5 inches measured between the cornices, giving a rise to chord ratio of about 40:1. This ratio necessitates a fairly substantial edge stiffening member which adds substantially to the overall weight of the roof.

Seven days after casting the wall-roof component of the cell which was free standing and unsupported, was loaded on the top of the roof with an evenly distributed load totalling 1.5 tons (i.e., about 30 lbs. sq. ft.) which produced a downward deflection of the roof of 0.14 inch at the center of the dome. After 2 hours the load was removed and the roof recovered fully.

An identical cell was constructed having superimposed on the roof 3 ribs, one positioned across the center of the shorter span, the others spaced 2.75 feet on each side of the centre rib. Each rib extended 3 inches above the upper surface of the roof and had a minimum width of 2 inches having sloping sides. The ribs contained 1 inch × 1 inch × 10 S.W.G. galvanized wire mesh steel reinforcement of folded top-hat section with a ⅜ inch diameter steel bar placed at the crown and a ¼ inch diameter bar placed either side of the base. The ribs extended the full extent of the 9.08 feet span.

This was loaded under the same loading conditions and the deflection was reduced to 0.08 inch. The inference to be drawn from this test is that the presence of the ribs adds to the strength of the roof. While the added strength was not significant for a cell of the dimensions tested the result indicates that the use of the ribs could be of value in the case of shells of different sizes and configurations.

The concrete mix used in the construction of the cells described above was:

1 part portland cement
1¼ parts sand
Common additives

Water was added to produce a grout having a viscosity suitable for pumping and a compressive strength in excess of 4.000 p.s.i. at 28 days.

As can readily be verified by experiment the weight per cubic foot of the concrete mixture described above including reinforcing is about 144 lbs per cubic foot. From this it follows that material one inch thick will weigh 12 lbs per square foot. Thus in the range of thicknesses referred to above, that is to say from ¼ inch to 2 inches for the walls and roof the range of weights per square foot will be from 3 lbs per square foot to 24 lbs per square foot, specific figures being as follows:

¼ inch — 3 lbs per square foot
⅜ inch — 4½ lbs per square foot
1½ inches — 18 lbs per square foot
2 inches — 24 lbs per square foot These figures are applicable when areas of localized thickening are disregarded as well as openings in the structure. In the particular embodiment of the invention described above it was found that by calculating the net internal surface area (exclusive of openings) including the surface area of corners dividing this into the total weight of the walls and ceiling and corners of the cell a 2 inches thick cell would have an average weight of 27.5 lbs per square foot, a 1½ inches thick cell, 21.4 lbs per square foot a ⅜ inch thick cell 7.2 lbs per square foot and a ¼ inch thick cell approximately 6 lbs per square foot. It will be appreciated however that in a general situation the figures calculated on this basis will vary with the size and shape of the room, the thickness and size of the areas of the localized thickening, with the shape of the roof, the presence or absence of ribs, the percentage steel reinforcement, the cement content and type of cement, the sand grading and shape of particles, the water to cement ratio and the proportions of doors and windows. The use of alternative materials such as for example, lightweight concrete would also make a big difference. For this reason it is preferred to specify the weight per unit in terms of the areas of the roof and walls from which localised thickening is absent.

To construct a building, cells are transported to the site which has been previously prepared and all preparatory work for drains, etc. is carried out. In the construction of a house the cells can be made with the floors of the cells cast in-situ as illustrated in FIG. 10. In this case, the site is cleared and levelled under the building and a layer of hard core or road base 28 is laid, levelled and compacted and the floor is cast in-situ. The cells are then placed in their correct positions on the floors as is indicated in FIG. 10. The cell walls 29 are spaced apart at a distance of about 1 inch or more to leave the necessary room between the adjacent cells for electrical conduits and plumbing pipes. As may be seen on the left of FIG. 10 the raft floor can be taken out beyond the cell wall so as to provide a footing for the external cladding 30, which is, for example, brick veneer.

In some circumstances the site is not suitable for a raft floor, in which case it is necessary to provide piers 31 as shown in FIG. 11. Here, the individual cells are simply placed so that their floors will rest or are attached to the tops of the piers, the walls of the adjacent cells being arranged as described above.

In FIG. 12 it will be seen that the central support has been omitted and the floors of adjacent cells supported by means of post — tensioning cables 32 passed through the ducts previously placed in the floors, to allow unrestricted larger areas below. To permit, for example, the provision of a garage underneath the house.

Doors and door fixings are located by bolting or similarly fixing between adjacent cells.

The assembly of cells constituting a house is surrounded by means of an external cladding which may be for example a brick veneer 30 (see FIG. 10) or thin pre-cast or manufactured sections fixed to or physically hung from the cells with additional vertical or lateral support external to the cells.

As has been mentioned above, the major part of one wall of a cell may be omitted to enable a larger room to be formed and the possibilities of this are illustrated in FIGS. 13*a* and 13*b* where two rooms are shown formed in this manner. It should be appreciated that under these circumstances, the roof edges of the two adjacent cells co-operate in providing a rigid structure despite the absence of a substantial portion of one wall of each cell. This is illustrated in FIG. 14 in which it will be seen that adjacent roofs 33 terminate in cornices 34, the portions of the walls of the cells below the cornices being omitted. To give greater strength to the cornice over the opening attachment or filling of the void between the cornices may be necessary.

A multi-story building as shown in FIG. 16 made up from cells constructed according to the invention may be constructed by arranging cells side by side and one on top of another. It will be appreciated that by reason of the convexity of the roofs of the cells, packing will be required along the edges of the floors of the cells to take this into account. The whole structure can be made rigid by the use of vertical and horizontal structural members. In addition vertical reinforced concrete columns may be formed at the intersections of cells to provide support for upper cells.

FIG. 16*a* shows an arrangement of cells in a multistory building each cell having a roof with a 1 to 27 rise to span ratio the floor to floor or story height being indicated at 40 and the rise at 42. FIG. 16*b* on the other hand shows an arrangement of cells with a 1 to 5 rise to span ratio, the floor to floor height being indicated at 41 and as is clearly seen from the drawing is substantially greater than the floor to floor height 40 of FIG. 16*a*. In that case the rise is indicated at 43. In both figures 44 indicates a support structure serving to transfer load, in the arrangement shown in FIG. 16*a* from an upper wall 46 to a lower wall 46 and in FIG. 16*b* from an upper wall 47 to a lower wall 47. At 45 is shown an independent support structure made of concrete pillars each of which serves to support the pillar above and the cells on either side of it.

FIG. 16*c* shows a cell 48 having a 1 to 5 rise to span ratio 50 as compared with a 1 to 27 rise to span ratio 49. The preferred rise to span ratio set out above is a range between 1:10 and 1:60. It was chosen because there are problems associated with both lower ratios and higher ratios outside this range. They are:

1. In Any Lower Ratio a. The doming becomes noticeable to the potential home purchaser and this would create some buyer resistance. There is evidence that one of the major constraints on market penetration of industrialised building systems occurs when there are noticeable differences requiring a consumer taste change in this very conservative market. The acceptability level of a pronounced dome would limit the success of the System, at least in the short term.

b. The height of the room is increased unnecessarily and this creates more space requiring heating or cooling.

c. An increase in the height of the dome affects stacking of the cells as shown in FIG. 16 of the drawing. Applied to existing fire and town planning provisions which limit the overall height of buildings, this wasted space could result in the loss of one story in a development.

d. In multi-story dwellings the increased dome height would affect stairways which would be higher and require a larger floor area, thus impacting on marketing and costs.

e. More materials would be required in the modules, in the support structure and in the cladding, such as brickwork.

f. If the space between the ceiling at cornice height of one module and the floor above of another module exceeds 1 foot 6 inches in height, then that space has to be separately fire protected by sprinklers or filled and sealed against fire transmission.

g. Modules cannot be transported on normal tray height trucks (48 inches to 52 inches) if the overall height from road level exceeds 14 feet 0 inches. Loads in excess of 14 feet 0 inches must travel at restricted times and on restricted routes, with some areas being completely ruled out due to the location of bridges and overhead wires. Low loader trucks are unsatisfactory due to inadequate springing and shock absorption to protect the modules from damage during transportation.

h. High domes create the necessity for roof trusses to be supported on packings (at extra cost) placed on the edge beams in order to raise the trusses above the dome. Additional costs would be incurred because of the extra brickwork required for cladding around the house. The high dome would also be more susceptible to damage whilst the trusses were being hoisted and placed in position.

2. If an attempt were made to reduce the overall height of the module with a lower rise to span ratio than the range chosen by lowering the spring line to a height of say 7 feet 0 inches (near the top of the door), then the following would apply:

a. The general ceiling height would be reduced because the cornice intrudes into the room and this would create a claustrophobic effect unacceptable to potential purchasers.

b. There would be architectural limitations because door heights and window head heights would be limited to approximately 6 feet 8 inches to coincide with the spring line.

c. Wardrobes, kitchen cupboards, curtains, etc., would have to be limited in height or specially designed at uneconomic costs.

d. Tiles or wall panelling would also be limited in height.

e. Problems and inconsistencies would result in the interpretation of ceiling height measurement by individual building inspectors to the extent that acceptance or rejection of ceiling height compliance could become speculative.

3. Higher Rise to Span ratios than the range chosen are unsatisfactory because:

a. It is considered they exceed the limit of the beneficial structural action of a dome.

b. Membrane stresses and edge disturbances build up excessively. This means the material is under higher stresses and therefore safety factors are reduced with creep becoming difficult to contain.

c. The ceiling begins to act more like a plate structure (flexural stresses) and therefore the thickness would have to be increased to compensate, which increases weight to the extent that a heavier wall is required to support the ceiling.

d. The rise to span ratio is measured across the short span and therefore at high ratios the problem of fitting a dome on a rectangular base becomes more difficult. This is due to the fact that the long span rise to span ratio is significantly greater and the problem of eliminating the negative camber towards the corner is insurmountable. The membrane dome action cannot operate if there is a major change in continuity of curvature in the diagonal corner, such as a negative camber.

e. Continuous edge stiffening members have to be disproportionately increased in size and strength at high ratios and any deflection of the member will have a greater effect on the flattening or dishing of the dome in the centre.

It is to be noted particularly that the domed roof in the cells illustrated meets the walls in a horizontal plane, that is to say the spring line for the roof does not vary in height along the length of a wall.

FIG. 15 shows how air conditioning ducts 35 may be accommodated in the cavity between the vertically adjacent cells 36 and 37 and electrical wiring 39 and plumbing pipes 40 between horizontally adjacent cells 37 and 38.

While it is proposed above that each cell should have its own individual floor, two upper cell components may share the same floor component. It will be appreciated that this will be practical only in connection with relatively small rooms side by side as otherwise the weight and size of the combined cells is likely to exceed the maximum desired weight and size for transportation and erection purposes.

The particulars given above are intended only to assist in an understanding of the invention and are not intended as a comprehensive guide to the construction of a building and many steps of a more or less conventional nature have been omitted for the sake of brevity.

If it were desirable for some reason not to attach the floor to the wall/roof component within the factory, it would be possible to transport the wall/roof component to the site and there attach it to a poured-in-situ or assembled floor, the necessary finishing work then being carried out.

In the case of multi-story buildings, it would be possible to level off and strengthen the roof of a cell or cells and then attach the upperwall/roof component to the levelled roof so that the levelled roof member would become the floor of the upper cell.

Whereas the preferred form of the invention has been described in connection with houses the invention may be readily applied to a wide variety of different types of building such as motels, hotels, service areas of office buildings, industrial buildings, sheds, mobile houses, hospitals. This list is not comprehensive but merely given to indicate the wide variety of uses to which cells constructed according to the invention may be put.

We claim:

1. A building comprising a plurality of structurally stable building cells, said cells being structured so that each forms at least part of a room of said building, each said cell comprising at least three planar, substantially vertical walls having an average thickness of about ¼ inch to about 2 inches except in minor areas of localized thickening, a substantially rectangular in plan, double continuous curved thin shell dome having substantially the structural action of a double curved thin-shelled dome, said dome being free of a major ridgeline, and extending from the tops of said walls and forming therewith an integral concrete structure, said roof having a rise to chord ratio not greater than 1:10 and not less than 1:60, the thickness of said roof being from about ¼ inch to about 2 inches except in minor areas of localized thickening, a continuous edge stiffening member joining said roof to the top of said walls, and serving to stiffen the edges of the roof to form, together with said walls and said roof, a structurally stable building cell, and a floor joined to the bottom of said walls, at least two of said cells being stacked one over the other in a stable generally vertical relationship.

2. Building according to claim 1, wherein the walls and the ceiling of said cell are about ⅜ inch to about 1½ inches thick.

3. Building according to claim 1, wherein said cell has four walls, with adjoining walls being at substantially right angles to one another.

4. Building according to claim 1, wherein the said rise to chord ratio is about 1:15 to about 1:45.

5. Building as claimed in claim 1, wherein said concrete contains at least one reinforcing material.

6. Building of claim 5, wherein said concrete is formed from a mixture of Portland cement, sand, water and conventional additives, and the reinforcement is steel.

7. Building according to claim 1, wherein said edge stiffening member has the internal appearance of a cornice cast integrally with the structure.

8. Building according to claim 1, wherein the walls and the roof of the cell are cast monolithically.

9. Building according to claim 8, wherein said concrete is reinforced with a steel welded mesh fabric.

10. Building according to claim 1, wherein at least one wall has at least one external reinforcing rib.

11. Building according to claim 1, wherein the floor of the cell is a reinforced concrete slab which is welded to the cell walls.

12. Building as claimed in claim 1, also including a plurality of said cells arranged in substantially the same horizontal plane.

13. Building according to claim 12, wherein the stacked cells are spaced apart a distance such as to permit the accommodation of air conditioning ducts and the like thereinbetween.

14. Building according to claim 13, wherein the plurality of cells arranged in substantially the same horizontal plane are spaced apart a distance such as to permit the accommodation of electrical wiring, plumbing pipes and the like thereinbetween.

15. Building according to claim 1, including vertical and horizontal members supporting at least one cell stacked over another cell.

16. Building according to claim 15, wherein at least four cells are located in substantially the same horizontal plane, with the cells generally abutting so that one corner of each cell is in the same general area, and said vertical structural members including at least one vertical reinforced concrete column located at the intersection of said cells in said area.

17. A building comprising a plurality of structurally stable reinforced concrete building cells, a plurality of said cells being arranged in substantially the same horizontal plane, and a stable plurality of said cells being arranged in substantially the same general vertical plane, said cells being structured to form at least part of a room of said building, each said cell comprising four substantially planar, substantially vertical reinforced concrete walls at substantially right angles to one another and having an average thickness of about ⅜ inch to 1½ inches except in minor areas of localized thickening, a substantially rectangular in plan, double continuous curved thin shell dome reinforced concrete roof having substantially the structural action of a double curved thin shell dome, said dome being free of a major ridgeline, and extending upwardly in a curve from the tops of each of said walls, said roof having a rise to chord ratio not greater than 1:10 and not less than 1:60, the thickness of said roof being from about ½ inch to about 2 inches except in minor areas of localized thickening, a continuous edge stiffening member joining said roof to the top of said walls and serving to stiffen the edges of the roof to form, together with said walls and said roof, a structurally stable building cell, and a floor joined to the bottom of said walls, wherein the top of the roof of said cell, when said cell is in an unsupported, free standing condition and at least seven days after casting same, when loaded for about 2 hours with an evenly distributed load of about 30 pounds per square foot, will exhibit substantially full recovery after load removal.

18. Building according to claim 17, further including support means supporting at least a portion of said cells over the cell immediately below each supported cell.

* * * * *